US009272888B2

(12) United States Patent
Owston

(10) Patent No.: US 9,272,888 B2
(45) Date of Patent: Mar. 1, 2016

(54) MACHINE AND METHOD OF MANUFACTURING A MACHINE

(75) Inventor: Edward Owston, Stoke-on-Trent (GB)

(73) Assignee: J.C. BAMFORD EXCAVATORS LIMITED, Uttoxeter (GB)

( * ) Notice: Subject to any disclaimer, the term of this patent is extended or adjusted under 35 U.S.C. 154(b) by 181 days.

(21) Appl. No.: 13/882,462

(22) PCT Filed: Nov. 2, 2011

(86) PCT No.: PCT/GB2011/052129

§ 371 (c)(1),
(2), (4) Date: Sep. 19, 2013

(87) PCT Pub. No.: WO2012/059754

PCT Pub. Date: May 10, 2012

(65) Prior Publication Data

US 2014/0365081 A1 Dec. 11, 2014

(30) Foreign Application Priority Data

Nov. 2, 2010 (GB) ..... 1018467.9

(51) Int. Cl.
*B66F 9/22* (2006.01)
*B66F 9/065* (2006.01)
(Continued)

(52) U.S. Cl.
CPC . *B66F 9/065* (2013.01); *B66F 9/22* (2013.01); *B66F 17/003* (2013.01); *E02F 3/283* (2013.01); *E02F 3/431* (2013.01); *E02F 3/433* (2013.01); *E02F 9/226* (2013.01)

(58) Field of Classification Search
CPC ..... E02F 9/226; E02F 3/431; E02F 3/283; E02F 3/433; B66F 9/065; B66F 17/003; B66F 9/22
USPC ..... 701/50
See application file for complete search history.

(56) References Cited

U.S. PATENT DOCUMENTS 4,522,109 A 6/1985 Marchi et al.
5,447,094 A 9/1995 Geyler, Jr.

FOREIGN PATENT DOCUMENTS

DE 31 16303 A1 11/1982
EP 1 635 001 A2 3/2006

(Continued)

OTHER PUBLICATIONS

Carlin, Jerry, "Everything you wanted to know . . . ", IVT International 2008, p. 30-35.*

(Continued)

*Primary Examiner* — Helal A Algahaim
*Assistant Examiner* — Genna Mott
(74) *Attorney, Agent, or Firm* — Marshall, Gerstein & Borun LLP

(57) ABSTRACT

A machine includes
- a machine body;
- a lifting arm assembly coupled to the machine body and carrying a pivotal mounting arrangement adapted to receive a working implement and being moveable between a raised and a lowered configuration;
- a compensation ram coupled between the machine body and the lifting arm assembly and configured to extend and retract;
- a tilt ram configured to move the pivotal mounting assembly between a crowd and a dump configuration, the tilt ram having a first and a second chamber; and
- a first sensor for sensing a hose burst signal,
- a second sensor for sensing a lift signal;
- a hose burst protection system such that fluid passes into the hose burst protection system, the hose burst protection system being configured to allow the passage of fluid from the second chamber when there is no hose burst signal.

23 Claims, 3 Drawing Sheets

(51) Int. Cl.

| | |
|---|---|
| ***B66F 17/00*** | (2006.01) |
| ***E02F 3/28*** | (2006.01) |
| ***E02F 3/43*** | (2006.01) |
| ***E02F 9/22*** | (2006.01) |

(56) References Cited

FOREIGN PATENT DOCUMENTS

| | | |
|---|---|---|
| GB | 2 163 126 A | 2/1986 |
| GB | 2 327 077 A | 1/1999 |
| JP | 02 147726 | 6/1990 |
| JP | 2004-301215 A | 10/2004 |

OTHER PUBLICATIONS

Search Report for GB 1018467.9, dated Mar. 3, 2011.

International Search Report for PCT/GB2011/052129, mailed Jan. 31, 2012.

* cited by examiner

MACHINE AND METHOD OF MANUFACTURING A MACHINE

FIELD OF THE INVENTION

Embodiments of the present invention relate to a machine including a hose burst protection system.

BACKGROUND OF THE INVENTION

A conventional machine including a load handling apparatus has a lifting arm assembly coupled at a proximal end thereof to a body of the machine and a loading implement coupled to the lifting arm assembly at a distal end thereof.

The coupling of the lifting arm assembly to the body of the machine is a pivotal coupling such that the loading implement can be raised or lowered with respect to the body of the machine by movement of the lifting arm assembly about the pivotal coupling.

Movement of the lifting arm assembly is typically achieved by the use of a lifting ram pivotally coupled at a first end to the body of the machine and at a second end to the lifting arm assembly.

The working implement is coupled to the lifting arm assembly by a pivotal joint such that the working implement can be moved about the pivotal joint between a crowding and a dumping configuration.

A tilt ram is normally provided to move the working implement between the crowding and dumping configurations. A first end of the tilt ram is coupled to the lifting arm assembly and a second end of the tilt ram is coupled to the working implement.

In order to maintain the working implement in a substantially fixed rotational relationship with respect to the machine body, a compensation system is provided. The compensation system includes a compensation ram which is connected to the lifting arm assembly and machine body in parallel with the lifting ram. Thus, an extension of the lifting ram will cause a corresponding extension of the compensation ram. A first chamber of the compensation ram (on a first side of a piston of the ram) is connected to a first chamber of the tilt ram (on a first side of the piston of the ram) and a second chamber of the compensation ram (on a second side of the piston of the ram) is connected to a second chamber of the tilt ram (on a second side of the piston of the ram), such that movement of the lifting arm assembly with respect to the machine body will cause movement of the working implement with respect to the lifting arm assembly in order to maintain a substantially fixed rotational relationship between the working implement and the machine body.

Hose burst protection systems are commonly used in such machines with a hydraulically operated load handling apparatus to reduce the risk of a failed hydraulic hose causing a loss of hydraulic fluid from the hydraulic circuit which would result in the lifting arm assembly falling or working implement tipping in an uncontrolled, undesired, and potentially dangerous manner.

GB2163126 shows a hose burst protection valve coupled between a tilt ram of a working implement and a compensating cylinder. As the lifting arm is raised fluid is transferred from the tilt cylinder to the compensation cylinder to allow the working implement to rotate and maintain a constant rotational relationship with the vehicle. During this process oil passes through the burst protection system. The hose burst protection valve is configured to be normally shut and only partially opens when the arm is lifted. Because of this, the pressure drop across the hose burst protection system is significant, and as such the fluid being transferred to the compensation cylinder is at relatively low pressure, and therefore is of no assistance in lifting the arm.

There is a desire to increase the maximum mass of the load which such machines can lift whilst maintaining the safe operation of the machine in the event of a hose burst event.

SUMMARY OF THE INVENTION

Thus according to the present invention there is provided a machine including: a machine body; a lifting arm assembly coupled to the machine body and carrying a pivotal mounting arrangement adapted to receive a working implement, the lifting arm assembly being moveable between a raised and a lowered configuration with respect to the machine body; a compensation ram coupled between the machine body and the lifting arm assembly and configured to extend and retract with movement of the lifting arm assembly between the raised and lowered configurations; a tilt ram configured to move the pivotal mounting assembly between a crowd and a dump configuration, the tilt ram having a first and a second chamber; and a first sensor for sensing a signal indicative of a hose burst event, a second sensor for sensing a signal indicative of a lift command for raising the lifting arm; a hose burst protection system coupled to the second chamber of the tilt ram such that fluid leaving the second chamber of the tilt ram passes into the hose burst protection system, the hose burst protection system being configured to allow the passage of fluid from the second chamber of the tilt ram to a chamber of the compensation ram when a signal indicative a hose burst event is not sensed by the first sensor and a signal indicative of a lift command is sensed by the second sensor.

By using a second sensor for sensing the signal indicative of a lift command, that signal may be used to fully open a valve of the host burst protection system, thereby allowing the pressure in the second chamber of the tilt ram to be transferred to the chamber of the compensation ram.

Thus according to a further aspect of the present invention there is provided a machine including: a machine body; a lifting arm assembly coupled to the machine body and carrying a pivotal mounting arrangement adapted to receive a working implement, the lifting arm assembly being moveable between a raised and a lowered configuration with respect to the machine body; a compensation ram coupled between the machine body and the lifting arm assembly and configured to extend and retract with movement of the lifting arm assembly between the raised and lowered configurations; a tilt ram configured to move the pivotal mounting assembly between a crowd and a dump configuration, the tilt ram having a first and a second chamber; and a sensor for sensing a signal indicative of a hose burst event and for sensing a signal indicative of a neutral circuit pressure, a hose burst protection system coupled to the second chamber of the tilt ram such that fluid leaving the second chamber of the tilt ram passes into the hose burst protection system, the hose burst protection system being configured to allow the passage of fluid from the second chamber of the tilt ram to a chamber of the compensation ram when a hose burst event is not sensed by the sensor and a neutral circuit pressure is sensed by the sensor.

By sensing both a hose burst event and a neutral circuit pressure, the neutral circuit pressure can be utilised to fully open or at least substantially fully open a valve of the hose burst protection system, and in the event that a hose burst event is sensed, that valve can be closed. Under these circumstances, in the event that no hose burst event is sensed, the pressure in the chamber of the tilt ram can be transferred to the chamber of the compensation ram.

BRIEF DESCRIPTION OF THE DRAWINGS

Embodiments of the present invention are described herein, by way of example only, with reference to the accompanying drawings in which.

DETAILED DESCRIPTION

Figure 1:
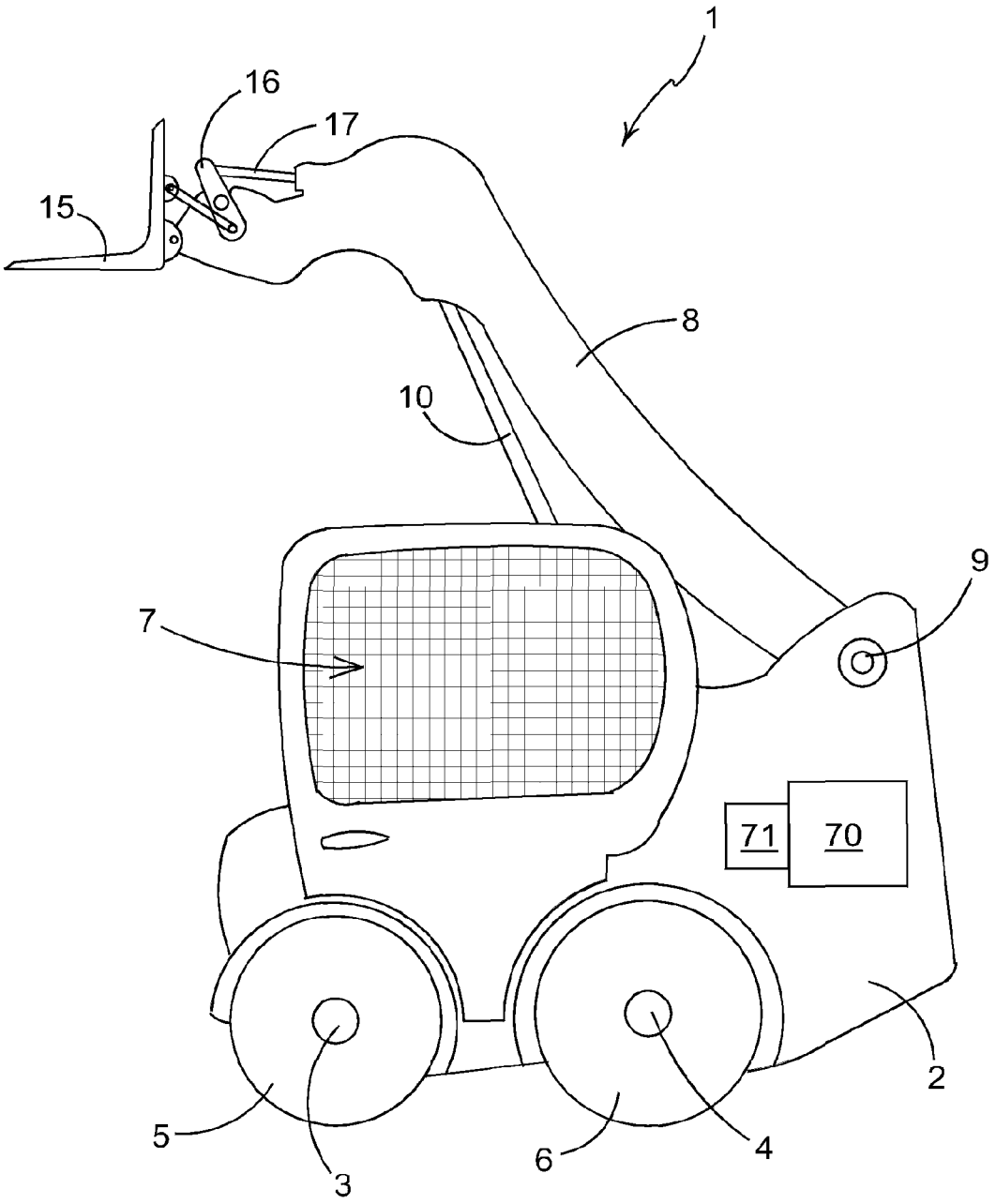
FIG. 1 shows a machine.
Figure 2:
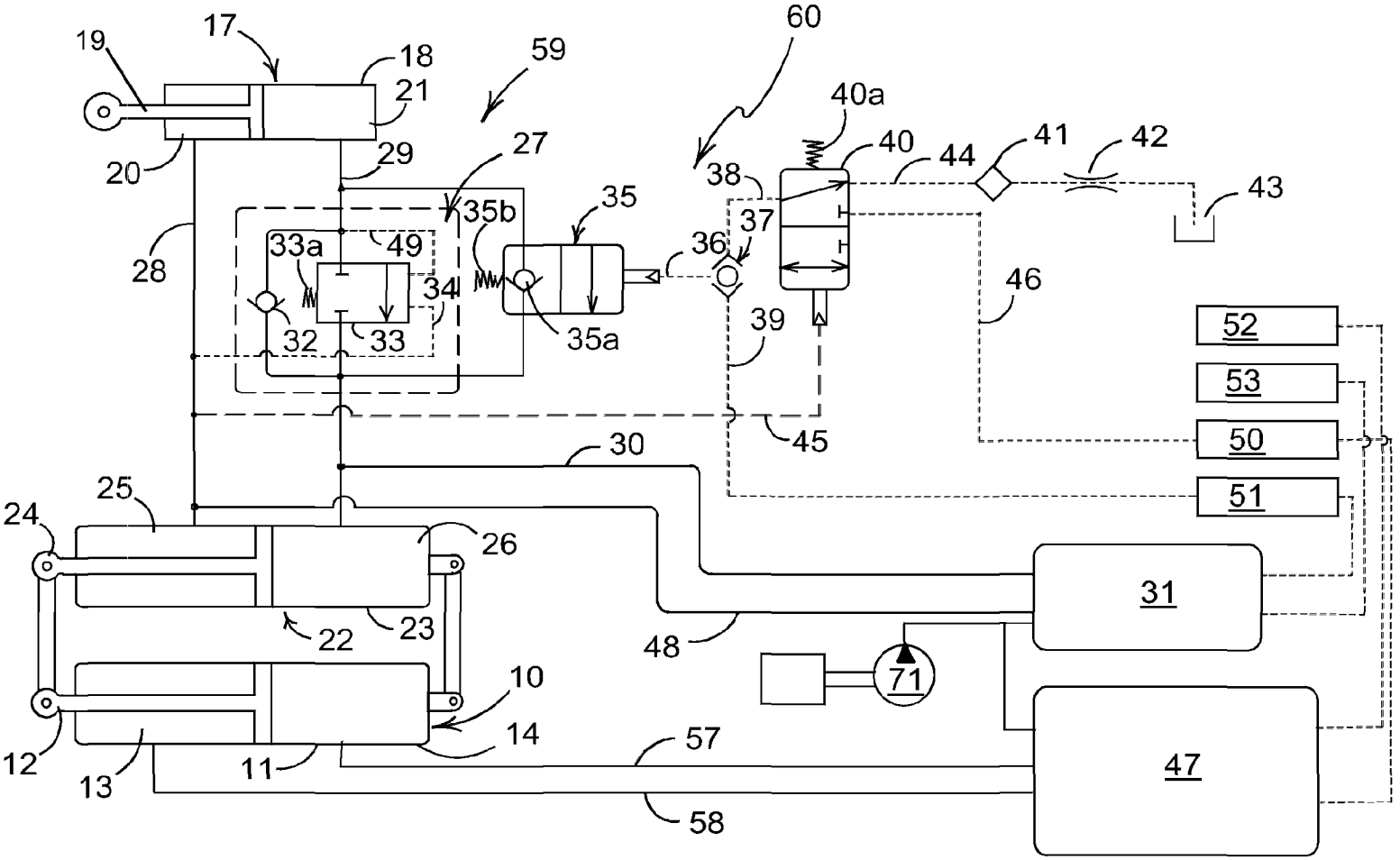
FIG. 2 shows a hydraulic circuit according to a first aspect of the present invention.

With reference to FIGS. 1 and 2, an embodiment of the present invention includes a machine 1 which may be a telescopic handler. The machine 1 includes a machine body 2 which, in the depicted embodiment of FIG. 1, is coupled to a first 3 and a second 4 axle, each axle being connected to a pair of wheels 5,6. One or both of the first 3 and second 4 axles are coupled to an engine of the machine 1 which is configured to drive movement of one or both pairs of wheels 5,6. Thus, when the wheels 5,6 are in contact with a ground surface, rotation of the wheels 5,6 may cause movement of the machine 1 with respect to the ground surface. At least one pair of wheels 5,6 is steerable with respect to the machine body 2. The engine 70, axles 3,4, and wheels 5,6 are part of a propulsion system configured to drive movement of the machine 1 with respect to a ground surface.

The machine 1 may include an operator cab 7 which is coupled to the machine body 2 and from which an operator can control operation of the machine 1. Accordingly, the operator cab 7 may be provided with a plurality of user operable controls. It will be understood that one or more of the user operable controls may be provided on a remote control unit which may or may not be physically connected to the machine 1.

The machine includes an engine 70 which acts to drive the wheels via a gearbox (not shown). The engine 70 also drives a hydraulic pump 71. The hydraulic pump supplies pressurised hydraulic fluid to various services of the machine, for example various hydraulic rams of the machine.

A lifting arm assembly 8 is coupled to the machine body 2 and is operable to move with respect to the machine body 2 between two or more configurations—such as a raised and a lowered configuration. In the depicted embodiment, the lifting arm assembly 8 is connected at a proximal end, by a pivotal joint 9, to the machine body 2 such that the lifting arm assembly 8 can rotate with respect to the machine body 1 between a lowered and a raised configuration.

In an embodiment, the pivotal joint 9 may be located towards a rear of the machine body 2 to one side of the operator cab 7 such that the lifting arm assembly 8 extends forwardly along at least part of a length of the machine body 2 and may be adjacent the operator cab 7.

In an embodiment, the pivotal joint 9 is located towards a front of the machine body 2 or substantially equidistant from the front and rear of the machine body 2.

In an embodiment, the pivotal joint 9 is located on a first part of the machine body 2, the first part of the machine body 2 being pivotally mounted to a second part of the machine body 2 such that the machine 1 is an articulated machine. The operator cab 7 may be provided on the second part of the machine body 2 in such an embodiment.

In an embodiment, a first end of a lifting ram 10 is coupled to the machine body 2 and a second end of the lifting ram 10 is coupled to the lifting arm assembly 8. Each coupling of the lifting ram 10 to the machine body 2 and to the lifting arm assembly 8 may be a pivotal coupling. The lifting ram 10 is a double acting ram. Thus, movement of the lifting arm assembly 8 between the raised and lowered configurations can be achieved by operating the lifting ram 10 to extend or retract the lifting ram 10.

The lifting ram 10 includes a cylinder part 11 and a piston part 12. The lifting ram 10 has a first chamber 13 to one side of the piston part 12, the first chamber 13 being annular in configuration, and a second chamber 14 to the other side of the piston part 12, the second chamber 14 being cylindrical in configuration. The piston part 12 of the lifting ram 10 may be towards the first end of the lifting ram 10 and the cylinder part 11 of the lifting ram 10 may be towards the second end of the lifting ram 10.

Extension of the piston part 12 from the cylinder part 11 of the lifting ram 10 causes the lifting arm assembly 8 to move towards the raised configuration and retraction of the piston part 12 from the cylinder part 11 of the lifting ram 10 causes the lifting arm assembly 8 to move towards the lowered configuration.

A lifting control system 47 is provided to control the supply of fluid under pressure (from pump 71) to the lifting ram 10 to cause extension or retraction of the piston part 12 from the cylinder part 11 of the lifting ram 10. The lifting control system 47 may be coupled to a user actuatable lifting control 50 to control the lifting control system 47.

In an embodiment, a working implement 15 is coupled to a distal end of the lifting arm assembly 8 (the distal end generally opposing the proximal end across a length of the lifting arm assembly 8). The working implement 15 may be a lifting fork or an earthmoving bucket, although any appropriate working implement could be used in embodiments of the invention depending on the task which the machine 1 is intended to perform.

The working implement 15 is, in an embodiment, coupled to the lifting arm assembly 8 by a pivotal mounting arrangement 16. The pivotal mounting arrangement 16 may be substantially irremovably received by and secured to the lifting arm assembly 8 and the working implement 15 may be removably secured to the pivotal mounting arrangement 16. In an embodiment, the working implement 15 is fixedly received by and secured to the pivotal mounting arrangement 16. In an embodiment, the working implement 15 and pivotal mounting arrangement 16 are integrally formed—thus the working implement 15 is received by the pivotal mounting arrangement 16 and integrally formed therewith.

The pivotal mounting arrangement 16 is moveable with respect to the lifting arm assembly 8 between a crowd and a dump configuration. Thus, a working implement 15 received by to the pivotal mounting arrangement 16 is also moveable with respect to the lifting arm assembly 8 between a crowd and a dump configuration.

A tilt ram 17 is coupled at a first end to the pivotal mounting arrangement 16 and at a second end to the lifting arm assembly 8. The tilt ram 17 is a double acting ram.

The tilt ram 17 includes a cylinder part 18 and a piston part 19. The tilt ram 17 has a first chamber 20 to one side of the piston part 19, the first chamber 20 being annular in configuration, and a second chamber 21 to the other side of the piston 19, the second chamber 20 being cylindrical in configuration. The piston part 19 of the tilt ram 17 may be towards the first end of the tilt ram 17 and the cylinder part 18 of the tilt ram 17 may be towards the second end of the tile ram 17.

Extension of the piston part 19 from the cylinder part 18 of the tilt ram 10 causes the pivotal mounting arrangement 16 to move towards the crowd position and retraction of the piston part 19 from the cylinder part 18 of the tilt ram 17 causes the pivotal mounting arrangement 16 to move towards the dump position.

A user actuatable dump control 51 and user actuatable crowd control 53 may be provided to control operation of the tilt ram 17.

When the lifting arm assembly 8 is moved about its pivotal joint 9 with respect to the machine body 2 between the lowered and raised configurations, the tilt ram 17 is automatically operated (i.e. without user input) to maintain the pivotal mounting arrangement 16 (and hence any working implement 15 received thereby) in a substantially fixed rotational relationship with the machine body 2. Thus, for example, the risk of a load supported by a working implement 15 secured to the pivotal mounting arrangement 16 slipping from the working implement 15 during movement of the lifting arm assembly 8 with respect to the machine body 2 is reduced. Maintenance of the load in a substantially fixed rotational relationship with the machine body 2 may be useful in the placement of the load on a surface which is generally parallel with a plane of the machine body 2.

In order to achieve appropriate automatic operation of the tilt ram 17, a compensation ram 22 is provided. The compensation ram 22 is a double acting ram. The compensation ram 22 is coupled between the lifting arm assembly 8 and the machine body 2 generally in parallel with the lifting ram 10. In other words, a first end of the compensation ram 22 is coupled to the machine body 2 and a second end of the compensation ram 22 is coupled to the lifting arm assembly 8. Each coupling of the compensation ram 22 to the machine body 2 and to the lifting assembly 8 may be a pivotal coupling. Thus, movement of the lifting arm assembly 8 between the raised and lowered configurations causes operation of the compensation ram 22 which acts to sense the position of the lifting arm assembly 8 with respect to the machine body 2 and, hence, movement of the lifting arm assembly 8 between the raised and lowered configurations.

The compensation ram 22 includes a cylinder part 23 and a piston part 24. Thus, the compensation ram 22 has a first chamber 25 to one side of the piston part 23, the first chamber 25 being annular in configuration, and a second chamber 26 to the other side of the piston part 24, the second chamber 26 being cylindrical in configuration. The piston part 24 of the compensation ram 22 may be towards the first end of the compensation ram 22 and the cylinder part 23 of the compensation ram 22 may be towards the second end of the compensation ram 22.

Movement of the lifting arm assembly 8 towards the raised configuration will cause extension of the piston part 24 from the cylinder part 23 of the compensation ram 22 and movement of the lifting arm assembly 8 towards the lowered configuration will cause retraction of the piston part 24 from the cylinder part 23 of the compensation ram 22.

The first chamber 25 of the compensation ram 22 is coupled by a first line 28 to the first chamber 20 of the tilt ram 17. Similarly, the second chamber 26 of the compensation ram 22 is coupled by a second line 29 to the second chamber 21 of the tilt ram 17.

Movement of the piston part 24 of the compensation ram 22 as the lifting arm assembly 8 is moved towards the lowered configuration causes hydraulic fluid to pass from the second chamber 26 of the compensation ram 22 to the second chamber 21 of the tilt ram 17—causing movement of the pivotal mounting arrangement 16 to maintain a substantially constant rotational relationship between the pivotal mounting arrangement 16 and the machine body 2. Similarly, movement of the piston part 24 of the compensation ram 22 as the lifting arm assembly 8 is moved towards the raised position causes hydraulic fluid to pass from the first chamber 25 of the compensation ram 22 to the first chamber 20 of the tilt ram 17—causing movement of the pivotal mounting arrangement 16 to maintain a substantially constant rotational relationship between the pivotal mounting arrangement 16 and the machine body 2.

The operator cab 7 may be provided with user actuatable controls 50,51,52,53, in the form of one or more joysticks, buttons, levers, or the like, to control operation of the machine 1 including movement of the lifting arm assembly 8 between the raised and lowered configuration and movement of the pivotal mounting arrangement 16 (and any working implement 15 secured thereto) between a crowd and a dump configuration.

In order to supply hydraulic fluid under pressure to the tilt ram 17 to move the tilt ram 17 between the dump and crowd configuration, a supply of hydraulic fluid is coupled to the tilt ram 17. As the tilt ram 17 moves with respect to the machine body 2 (as a result of the raising and lowering of the lifting arm assembly 8), a third line 30 is provided between the tilt ram 17 and a dump/crowd control system 31, and the third line 30 includes at least a portion which is flexible hose.

The third line 30 is preferably coupled to the second line 29 which couples the second chambers 21,26 of the tilt 17 and compensation 22 rams.

The dump/crowd control system 31 is also coupled by a sixth line 48 to the first chamber 20 of the tilt ram 17, and this coupling may be via the first line 28.

A hose burst protection assembly 59 is provided to seek to reduce the risk of, for example, a burst hydraulic hose causing uncontrolled or undesired operation of the machine 1. Thus, the hose burst protection assembly 59 may be provided between the tilt ram 17 and the flexible part of the third line 30. This hose burst protection assembly 59 is configured to reduce the risk of uncontrolled or undesired movement of the pivotal mounting arrangement 16 towards the dumping configuration in the event of the flexible part of the third line 30 failing; for example, the hose burst protection assembly 59 may, for example, be located in the second line 29 which couples the second chambers 21,26 of the tilt 17 and compensation 22 rams.

The hose burst protection assembly 59 primarily consists of a first hose burst protection system 27 and a second hose burst protection system 60. The first hose burst protection system 27 primarily consists of check valve 32, pilot valve 33 and associated connections. The second hose burst protection system primarily consists of valve 35, control valve 40 and associated hydraulic connections.

As can be seen from FIG. 2, the first hose burst protection system 27 is in parallel with the valve 35 of the second hose burst protection system 60.

Operation of the second hose burst protection system 60 in summary, is as follows:—

With the valve 35 positioned as shown in FIG. 2 (in a first configuration) the check valve 35A prevents fluid flowing from the second chamber 21 to the second chamber 26. When no hose burst has been detected and a lift command has been instigated, the valve 35 moves to a second configuration (not shown) wherein fluid can flow from the second chamber 21 through valve 35 to the second chamber 26. However, in the event of detection of a hose burst protection when the valve 35 is in its second configuration the system is arranged for the valve to move to its first configuration thereby acting as the hose burst protection system. In the event that a hose burst occurs when the valve 35 is in the first configuration shown in FIG. 2, the system is arranged to ensure that the valve cannot move to the second configuration.

In more detail, the valve 35 is provided to allow fluid to pass from the second chamber 21 of the tilt ram 17 to the second chamber 26 of the compensation ram 22 during movement of the lifting arm assembly towards the raised configuration.

The valve 35 is connected between the tilt ram 17 and the compensation ram 22 in parallel with the first hose burst protection system 27. The valve 35 is normally in the first configuration (as shown in FIG. 2) in which the valve 35 acts as a check valve such that the passage of fluid therethrough in a direction away from the second chamber 21 of the tilt ram 17 along the second line 29 is prevented but fluid above the cracking pressure of the first configuration of the valve 35 is permitted to pass through the valve 35 in the direction towards the second chamber 21 of the tilt ram 17 along the second line 29.

The valve 35 is arranged for actuation, on the supply of a pilot pressure to the valve 35 along on control line 36, to adopt a second configuration such that the flow of fluid therethrough from the second chamber 21 of the tilt ram 17 along line 29 is permitted.

The control line 36 is connected to a shuttle valve 37 which, in turn, is connected, on the one hand, to a control valve 40 by a fourth line 38 and, on the other hand, to a dump control line 39.

The control valve 40 is biased towards a first configuration (as shown in FIG. 2) in which fluid from line 36 is permitted to pass along the fourth line 38 through the control valve 40 to a filter 41 and flow restrictor 42 along a fifth line 44 to a low pressure reservoir 43 of hydraulic fluid. The filter 41 is provided to protect the flow restrictor 42 and may be omitted in some embodiments. The flow restrictor 42 and the reservoir 43 are provided to assist operation of the shuttle valve 37 as will become apparent.

The control valve 40 is actuatable to a second configuration (not shown) by supply of a pilot pressure on a pressure sensing line 45. In the second configuration, the control valve 40 is configured to allow a fluid pressure signal in lift control line 46 to pass through the control valve 40, through shuttle valve 37 and on to the valve 35.

The pressure sensing line 45 is coupled to the first chamber 20 of the tilt ram 17, and this coupling may be via the first line 28 or may be a substantially direct coupling.

Operation of the machine is as follows: When the machine is not being used, the engine will be stationary and the hydraulic pump will be stationary. Accordingly, the hydraulic pressure within the hydraulic system will have decayed to zero. The pilot valve 33 will be positioned as shown in FIG. 2, the valve 35 will be positioned as shown in FIG. 2 and the control valve 40 will be positioned as shown in FIG. 2.

When it is required to use the machine, an operator will enter the operator cab 7 and start the engine of the machine, which in turn will start the hydraulic pump of the machine. The hydraulic pump causes certain parts of the hydraulic system to be raised to a pressure known as the "neutral circuit pressure". For the purposes of explanation, it is assumed that the neutral circuit pressure of the machine 1 is 10 bar (though in further embodiments the neutral circuit pressure could be greater than 10 bar or less than 10 bar). This results in the first chamber 25, first chamber 20 and first line 28 being raised to the neutral circuit pressure, in this example 10 bar. Note that the pressure in the first line 28 raises to the neutral circuit pressure simply upon starting the engine, it is not necessary for the operator to operate any of the user actuable control 50, the user actuable dump control 51, user actuable control 52, or user actuable crowd control 53.

Because first line 28 rises to the neutral circuit pressure, the control valve 40 senses the presence of the neutral circuit pressure via pressure sensing line 45. The control valve 40 (by virtue of configuring spring 40*a* at an appropriate spring rate) is arranged to move to its second configuration (not shown) from its first configuration shown in FIG. 2 upon sensing of the neutral circuit pressure (in this example 10 bar).

Valve 35 will be in the position shown in the position shown in FIG. 2 because line 36 is vented to tank 43. Valve 33 will be in the position shown in FIG. 2 because the spring rate of spring 33*a* is such that it holds the valve in the FIG. 2 position in spite of line 34 applying the neutral circuit pressure to the opposite end of the valve.

Thus, with the machine's engine running and with the operator not operating any of the user actuable controls, the pilot valve 33 and the valve 35 are in the position shown in FIG. 2 whereas the control valve 40 has moved to its second configuration (not shown).

When the operator commands a lift operation by actuating the user actuable lifting control 50, the lifting control system 47 is caused to operate and also a signal indicative indicative of the lift command (in the form of an increase in pressure) is transmitted to lift control line 46. Because the control valve 40 has moved to its second configuration (as a result of the neutral circuit pressure in pressure sensing line 45 as described above) the signal in lift control line 46 is transmitted through control valve 40 to the fourth line 38 and then through the shuttle valve 37 and through control line 36 to the valve 35. The signal pressure is such that the valve 35 moves to its second configuration (not shown) such that the second chamber 21 is connected via the valve 35 to the second chamber 26.

Thus, when the operator commands a lift operation fluid at an operating pressure (e.g. a pressure above the neutral circuit pressure) is supplied from the hydraulic pump via the lifting control system 47 to the second chamber 14 of the lifting ram 10 through a seventh line 57 and fluid passes from the first chamber 13 of the lifting ram 10 to the lifting control system 47 through an eighth line 58. As a result, the piston part 12 of the lifting ram 10 extends with respect to the cylinder part 11 and the lifting arm assembly 8 moves towards the raised configuration.

As a result of the movement of the lifting arm assembly 8, the piston part 24 of the compensation ram 22 also extends with respect to the cylinder part 23 of the compensation ram 22. Fluid from the first chamber 25 of the compensation ram 22 passes through line 28 to the first chamber 20 of the tilt ram 17 to cause retraction of the piston part 19 of the tilt ram 17 with respect to the cylinder part 18 of the tilt ram 17.

As piston part 19 retracts, fluid in the second chamber 21 passes through the now open valve 35 and into the second chamber 26. Significantly, because valve 35 has been opened by virtue of the pressure signal in control line 46 resulting from operation of the user actuable control 50, it is possible to arrange for valve 35 to be substantially fully open and therefore the pressure drop across valve 35 can be largely eliminated. This results in the pressure in the second chamber 21 being substantially similar to the pressure in the second chamber 26 and this pressure typically will be significantly above the neutral circuit pressure. As a result the net pressure acting on piston part 24 is in an extending direction of the compensation ram 22 and this therefore assists in lifting the lifting arm assembly 8 towards the raised position. The arrangement therefore provides a method of transferring the fluid pressure in the second chamber 21 to the tilt ram to the second chamber 26 of the compensating ram which assists the lift ram when lifting the lifting arm assembly 8. Accordingly, it is possible for this system of the present invention to raise heavier loads or alternatively utilise smaller lift rams.

It should be noted that when a load is supported by the pivotal mounting arrangement 16 (for example, on a working implement 15), at least part of the weight of that load will act on the piston part 19 of the tilt ram 17 to cause an increase in the pressure of hydraulic fluid in the second chamber 21 of the tilt ram 17. Valve 35, when in its second configuration allows this increase in pressure in the second chamber 21 to be transferred to the second chamber 26 to cause the compensation ram to assist the lift ram during lifting of the arm 8.

When the operator commands a lower operation by actuating the user actuable control 52, the lifting control system 47 allows fluid to vent from the second chamber 14 and pass into the first chamber 13 as the lift ram 10 retracts. Retraction of the lift ram 10 causes a corresponding retraction of the compensating ram 22 which causes fluid in the second chamber 26 to at least vent via the valve 35 (which will be in its first configuration) to the second chamber 21. Fluid from the first chamber 20 will vent via first line 28 to the first chamber 25.

Consider the situation when a lifting arm assembly 8 is being lifted and part of line 30 bursts. Just prior to the burst event occurring the valve 35 will be in its second configuration such that the second chamber 21 is vented via the valve 35 to the second chamber 26. When third line 30 bursts, at this instant, the second chamber 21 is, in effect, vented to atmosphere, and at this instant, piston part 19 is caused to retract into the cylinder part 18. The piston part 19 will retract into the cylinder faster than the first chamber 20 can be replenished with fluid. As such, the pressure in the first chamber 20 drops and in particular it will fall to below the neutral circuit pressure (in this case 10 bar). Once the pressure in the first chamber 20 has fallen to below the neutral circuit pressure, the pressure in first line 28 will similarly fall and the pressure signal in pressure sensing line 45 will similarly fall. This will cause spring 40A to move the control valve 40 to its first configuration (as shown in FIG. 2). Once the valve 40 is in its first configuration then control line 36 is vented to the low pressure reservoir 43 via valve 40 and spring 35B causes the valve 35 to move to its first configuration (as shown in FIG. 2) thereby preventing any more fluid exiting the second chamber. Valve 35 therefore acts as a hose burst protection valve.

Even with the line 30 burst, the lift arm assembly 8 can be lowered in a controlled manner by operating the user actuable control 52. Under these circumstances fluid will be vented from the second chamber 14 and will pass into the first chamber 13 of the lift ram. Similarly, fluid will vent from the second chamber 26 of the compensation ram via check valve 32 and/or check valve 35A into the second chamber 21 and fluid will vent from the first chamber 20 via first line 28 into the first chamber 25.

Even with a burst third line 30, it is possible to retract the tilt ram cylinder by operating the actuable dump control 51. Under these circumstances, when the actuable dump control 51 is operated by the operator, the pressure signal is fed to the dump control line 39 which causes controlled movement of the valve 35 from its first condition towards its second condition. This controlled movement of the valve 35 causes controlled venting of the second chamber 21. Fluid vented from the second chamber 21 may vent to atmosphere, but this may be a safer option than to leave the tilt ram in the position it was in when the burst occurred.

In the event that valve 35 fails in first configuration as shown in FIG. 2, the first hose burst protection system 27 will operate so as to allow lifting and lowering of the lifting arm assembly 8, though lifting of the lifting arm assembly 8 will be at a reduced lifting capacity as follows:—

The first hose burst protection system 27 includes a pilot valve 33 and a check valve 32. A pilot line 34 is connected between the pilot valve 33 and the first line 28. The pilot valve 33 is normally closed to prevent the flow of fluid therethrough but may be partially opened when the lifting arm is being raised by a pilot pressure on the pilot line 34 to allow the flow of fluid from the second chamber 21 of the tilt ram 17 through the first hose burst protection system 27 along the second line 29 towards the second chamber 26 of the compensation ram 22. The check valve 32 is orientated to prevent the flow of fluid from the second chamber 26 of the compensation ram 22 but to permit the flow of fluid in the opposite direction if the fluid pressure is above the cracking pressure of the check valve 32—thus bypassing the pilot valve 33.

Following a lift command (with valve 35 failed in its first configuration). Lift ram 10 and compensation ram 22 will start to extend causing the first chamber 25 to reduce in volume and hence causing the pressure in line 28 to increase above the neutral circuit pressure. At this instant, fluid from the second chamber cannot vent because valve 35 has failed in its first configuration as shown in FIG. 2, and valve 33 is, at this instant, in its first configuration shown in FIG. 2. An increase in the pressure in line 28 causes the pressure in pilot line 34 to also increase to a pressure where spring 33*a* is overcome causing the pilot valve 33 moves towards its second configuration and partially open. At the point at which valve 33 allows a relatively small amount of fluid to vent from the second chamber 21, the pressure in the first chamber 20 will reduce, thereby reducing the pressure in pilot line 34 which will allow spring 33*a* to move the pilot valve 33 towards its first configuration. Because the second chamber 21 can no longer vent, then the pressure in the first chamber 20 then increases thereby increasing the pressure to the pilot line 34 which causes the pilot valve 33 to move towards its second configuration. As will be appreciated under these circumstances, and depending upon the characteristics of the particular machine, the pilot valve 33 only ever opens a relatively small amount, sufficient to just vent the second chamber 21. As a result of this, the pressure drop across the pilot valve 33 is significant and as such the pressure in second chamber 26 of the compensation ram will be significantly lower than the pressure in the second chamber 21 of the tilt ram. This results in the pressure difference across the piston part 24 between the first chamber 25 of the compensation ram and the second chamber 26 of the compensation ram being relatively small and therefore the compensation ram is unable to significantly improve the lift capacity of the machine, i.e. it is unable to significantly assist the lift ram 10 when the load is being raised.

As will be appreciated, the pilot valve 33 acts as a hose burst protection valve because in the event of say third line 30 bursting whilst the lifting arm assembly 8 is being raised and the valve 35 has already failed in its first configuration, then the pressure in the first line 28 will fall and hence the pressure in the pilot line 34 will fall to a sufficiently low value and the spring 33A will cause the valve 33 to move to its first configuration as shown in FIG. 2 thereby preventing the further venting of the second chamber 21 of the tilt ram.

Note that with the machine engine running and with the operator not operating any of the user actuable controls, and with the valve 35 failed in its first configuration, the valve 33 will be in its first configuration as shown in FIG. 2 because the neutral circuit pressure in line 34 will be unable to overcome the spring 33*a*.

A pressure release pilot line 49 is also provided. The pressure release pilot line is coupled to the pilot valve 33 of the first hose burst protection system 27 and to the second chamber 21 of the tilt ram 17 and configured to supply a pilot pressure to the pilot valve 33 in the event that the pressure in the second chamber 21 of the tilt ram 17 exceeds a threshold pressure, to cause the pilot valve 33 to adopt the second configuration. This may occur, for example, if the associated loading implement is inadvertently driven into a solid objection causing a pressure in the second chamber in excess of a safe limit. A pressure release valve can be provided downstream of the valve 33 to relieve any excess pressure in the second chamber 21 via the valve 33.

As described above, control valve 40 acts a sensor for sensing a signal indicative of a hose burst event and can also act as a sensor for sensing a signal indicative of the absence of a hose burst event. Thus, in the absence of a hose burst event, with the machine being operated, the first chamber will be at or above a neutral circuit pressure and this pressure is sensed by control valve 40 which is caused to move to its second configuration. Control valve 40 senses a hose burst event because under these circumstances the pressure in the first chamber 20 will fall below the neutral circuit pressure and this falling pressure is sensed by a control valve 40 in as much as spring 40A moves the control valve 40 to its first configuration as shown in FIG. 2.

In further embodiments, the control valve 40 could be an electrically operated valve and a pressure sensor outputting an electric signal could be used to determine the pressure in the first chamber, this electric output signal being used to control the position of the control valve.

Valve 35 acts as a second sensor for sensing a signal indicative of a lift command (in this case the pressure signal in line 46).

As will be appreciated, the hose burst protection assembly 59 is coupled to the second chamber of the tilt ram such that fluid leaving the second chamber of the tilt ram passes into the hose burst protection assembly 59. Hose burst protection assembly 59 is configured to allow the passage of fluid from the second chamber of the tilt ram to the second chamber of the compensation ram upon valve 35 sensing a signal indicative of a lift command and when it is safe to do so, i.e. when a signal indicative of a hose burst event has not been sensed by control valve 40.

As described above, machine 1 has two hose burst protection systems, namely the first hose burst protection system 27 and the second hose burst protection system 60. In a further embodiment the first hose burst protection system 27 may be deleted, i.e. the valve 33 and check valve 32 may be deleted.

The hose burst protection assembly 59 may or may not be attached to (mounted on) the ram to which it is coupled.

In an embodiment, the first hose burst protection system 27 is attached to or disposed on the tilt ram 17. In an embodiment, the valve 35 is attached to or disposed on the tilt ram 17. In an embodiment, the control valve, and/or the shuttle valve 37 is attached to or disposed on the tilt ram 17. In an embodiment, one or more of the first hose burst protection system 27 and the valve 35 are attached to or disposed on the lifting arm assembly 8. In an embodiment, the shuttle valve 37 and/or the control valve 40 are attached to or disposed on the lifting arm assembly 8. In an embodiment, the shuttle valve 37 and/or the control valve 40 are attached to or disposed on the machine body 2.

Embodiments of the invention may use an electrically controlled valve 35 rather than a hydraulically operated pilot valve. Under such circumstances a control system may be provided to allow a lift command signal in the form of an electrical signal to pass to valve 35 when it is safe to do so (i.e. in the absence of a hose burst event) and prevent any such signal passing to valve 35 in the event of a hose burst event.

The lifting arm assembly 8 may be a telescopic lifting arm assembly with an inner part and an outer part telescopically mount to each other. An extension ram may be provided to operate extension of the telescopic lifting arm.

A hose burst event is the loss of hydraulic fluid from the hydraulic circuit. This may occur, for example, as a result of failure of a flexible hose. However, such events can also occur as a result of failure of a rigid pipe. Embodiments of the present invention have been described with reference to a hose burst event comprising failure of a flexible part of the third line 30. However, it will be appreciated that a hose burst event may occur due to the failure of other components.

The term "line" has been used herein to describe conduits for hydraulic fluid. These conduits may comprise flexible hoses or rigid pipes or a combination thereof.

The user actuatable controls 50,51,52,53 are coupled to the lifting control system 47 and the dump/crowd control system 31.

It will be understood that embodiments of the present invention include an automatic control of a hose burst protection assembly 59 based on one or more control signals (i.e. commands) and a signal which varies to indicate a hose burst event.

The first sensor may sense a signal indicative of a hose burst event. In an example the signal indicative of a hose burst event may be a signal indicative of a pressure in a part of the hydraulic circuit being below a predetermined pressure. The predetermined pressure may be a neutral circuit pressure.

The first sensor may sense a signal indicative of the absence of a hose burst event. In an example the signal indicative of the absence of a hose burst event may be a signal indicative of a pressure in a part of the hydraulic circuit above a predetermined pressure. The predetermined pressure may be a neutral circuit pressure.

The second sensor may sense a signal indicative of a lift command. In an example the signal indicative of a lift command may be a signal indicative of a pressure in a part of the hydraulic circuit being above a predetermined pressure.

The second sensor may sense a signal indicative of the absence of a lift command. In an example, the signal indicative of the absence of a lift command may be a pressure in a part of the hydraulic circuit being below a predetermined pressure.

As described above, the signal indicative of the lift command is a pressure in line 46, though in other embodiments signals indicative of a lift command could be generated by alternative means.

Figure 3:
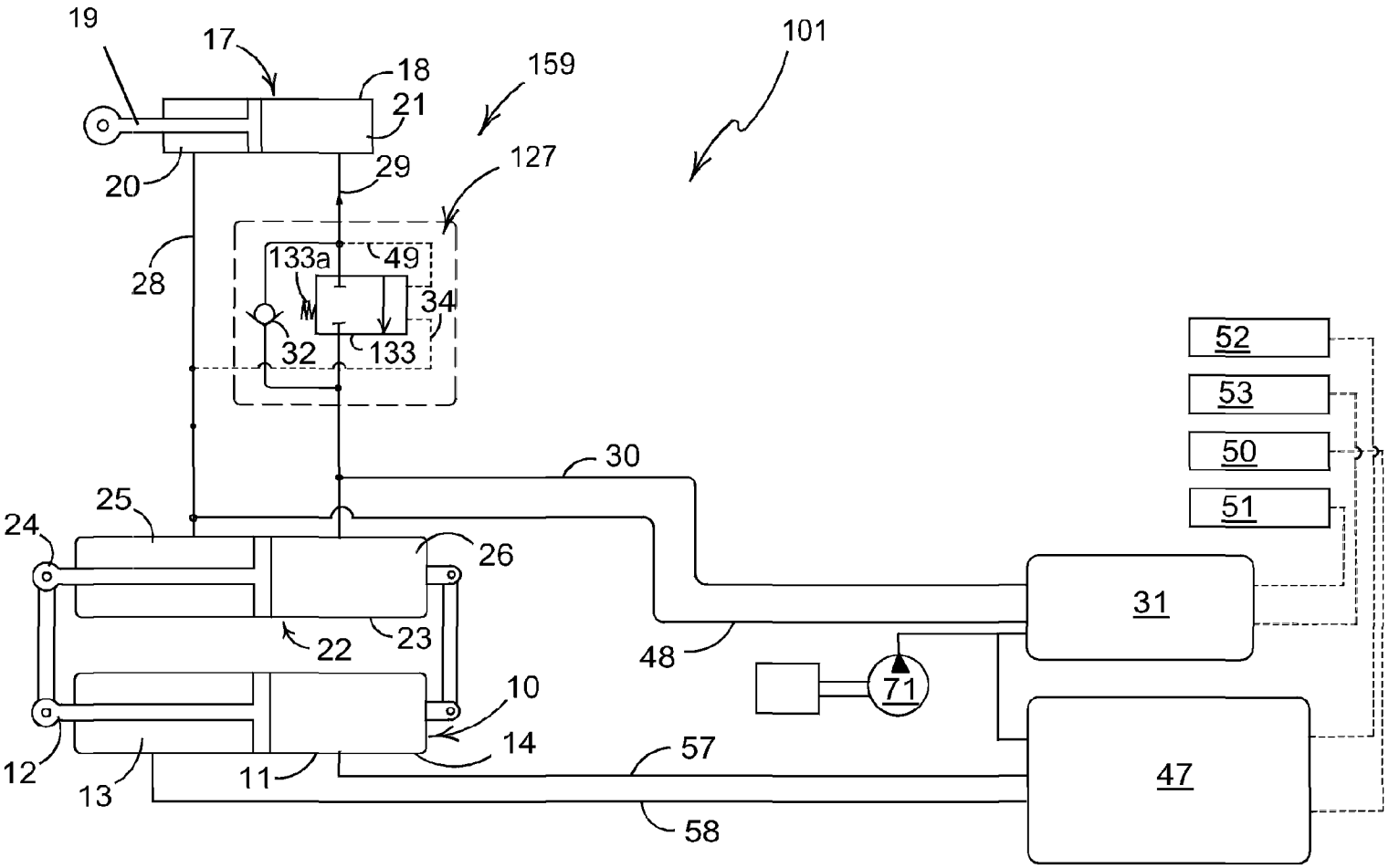
FIG. 3 shows a hydraulic circuit according to a second aspect of the present invention.

With reference to FIG. 3, there is shown a further embodiment of a hose burst protection assembly 159. In this case the hose burst protection assembly 159 includes a hose burst protection system 127. Hose burst protection system 127 is identical to the first hose burst protection system 27 as shown in FIG. 2 except for valve 133 and spring 133A.

The only difference between valve 133 and 33 is a difference in corresponding springs 133A and 33A.

The remaining components shown in FIG. 3 are identical to the similarly numbered components shown in FIG. 2, however operation of the host burst protection assembly 159 is different to operation of the hose burst protection assembly 59.

Thus, the spring rate of spring 133A is lower than the spring rate of spring 33A. In particular, when the machine engine is running and with the operator not operating any of the user actuable controls, the pressure in line 28 will be the neutral circuit pressure. This neutral circuit pressure will be applied, via line 34 to the right hand end of the valve 133 (which is a spool valve). The spring rate of spring 133A is such that when a neutral circuit pressure is applied to the right hand end of the spool of valve 133 via line 34 the valve moves to its second configuration (not shown) whereby the second chamber 21 is hydraulically connected to the second chamber 26.

Operation of the hose burst protection assembly 159 is as follows.

When the machine is not being used, the engine will be stationary and the hydraulic pump will be stationary. Accordingly, the hydraulic pressure within the hydraulic system will have decayed to zero. Pilot valve 133 will be positioned as shown in FIG. 3.

When it is required to use the machine, an operator will enter the operator cab and start the engine of the machine, which in turn will start the hydraulic pump of the machine. The hydraulic pump will cause certain parts of the hydraulic system to be raised to a neutral circuit pressure. This results in the first chamber 25, first chamber 20, first line 28 and line 34 being raised to neutral circuit pressure. This causes the valve 133 to move to its second configuration (not shown) whereby the second chamber 21 is connected to the second chamber 26. The spring 133A and the neutral circuit pressure can be configured such that valve 133 is fully open, or substantially fully open under these circumstances. When lifting arm assembly 8 is raised, lifting ram 10 extends, thereby extending the compensation ram 22 causing fluid to vent from the first chamber 25 to the first chamber 20 and causing fluid to vent from the second chamber 21 via the fully open or substantially fully open valve 133 to the second chamber 26. As such, the pressure in the second chamber 21 is transferred to the second chamber 26 thereby assisting the lifting ram 10 to lift the load.

In the event of line 30 bursting, i.e. in the event of a hose burst event, the pressure in line 28 will fall as described with reference to FIG. 2. In particular the pressure in line 28 as shown in FIG. 3 will fall to a pressure below the neutral circuit pressure. Once this has occurred the pressure in line 34 as shown in FIG. 3 will fall to below the neutral circuit pressure and spring 133A will cause the spool of valve 133 to move to the right when viewing FIG. 3 thereby closing the valve 133.

As will be appreciated, at all times when the engine of machine 101 is running and there is no hose burst event, pressure in line 28 will always be at at least the neutral circuit pressure, and therefore the valve 133 will always be fully open or substantially fully open. Only in the event of a hose burst will valve 133 close. As will be appreciated, valve 133 acts as a sensor. Valve 133 may sense a signal indicative of a hose burst event whilst the machine is in operation, since valve 133 can sense a pressure below a predetermined pressure, in this example that predetermined pressure being the neutral circuit pressure. The valve 133 can also sense the neutral circuit pressure, because when the neutral circuit pressure is applied to the valve via line 34 the valve moves from its first configuration to its second configuration.

When used in this specification and claims, the terms "comprises" and "comprising" and variations thereof mean that the specified features, steps or integers are included. The terms are not to be interpreted to exclude the presence of other features, steps or components.

The invention claimed is:

1. A machine including:

a machine body;

a lifting arm assembly coupled to the machine body and carrying a pivotal mounting arrangement adapted to receive a working implement, the lifting arm assembly being moveable between a raised and a lowered configuration with respect to the machine body;

a compensation ram coupled between the machine body and the lifting arm assembly and configured to extend and retract with movement of the lifting arm assembly between the raised and lowered configurations;

a tilt ram configured to move the pivotal mounting assembly between a crowd and a dump configuration, the tilt ram having a first and a second chamber;

a first sensor for sensing a signal indicative of a hose burst event by sensing a signal indicative of a fluid pressure in the first chamber of the tilt ram;

a second sensor for sensing a signal indicative of a lift command for raising the lifting arm; and a hose burst protection system coupled to the second chamber of the tilt ram such that fluid leaving the second chamber of the tilt ram passes into the hose burst protection system, the hose burst protection system being configured to allow the passage of fluid from the second chamber of the tilt ram through the second sensor to a chamber of the compensation ram when a signal indicative a hose burst event is not sensed by the first sensor and a signal indicative of a lift command is sensed by the second sensor.

2. The machine as defined in claim 1, wherein the hose burst protection system is configured to permit the flow of fluid from the second chamber of the tilt ram if the tilt ram is being controlled to move the pivotal mounting arrangement towards the dump configuration.

3. The machine as defined in claim 1 wherein during operation of the machine the first chamber operates at least at a neutral circuit pressure and the first sensor senses a signal indicative of a hose burst event by sensing the signal indicative of a fluid pressure in the first chamber of the tilt ram having fallen below the neutral circuit pressure.

4. The machine as defined in claim 1, wherein the first sensor is a pressure sensor which outputs an electric signal representative of the fluid pressure in the first chamber of the tilt ram.

5. The machine as defined in claim 1 wherein the first sensor is a control valve hydraulically coupled to the first chamber of the tilt ram to sense the fluid pressure in the first chamber of the tilt ram.

6. The machine as defined in claim 1 including a valve operable to allow the passage of fluid from the second chamber of the tilt ram to the chamber of the compensation ram upon the valve sensing the signal indicative of the lift command.

7. The machine as defined in claim 6 wherein the valve is operable to allow the passage of fluid from the second chamber of the tilt ram to the chamber of the compensation ram upon sensing a signal indicative of a dump command.

8. The machine as defined in claim 7 wherein said valve is operable to prevent the passage of fluid from the second chamber of the tilt ram to the chamber of the compensation ram in the absence of said signal indicative of the lift command and said signal indicative of the dump command.

9. The machine as defined in claim 6 including a control system operable to communicate the signal indicative of the lift command to the second sensor when the signal indicative of a hose burst event is not sensed and the control system is operable to prevent communication of the signal indicative of the lift command signal to the second sensor when a signal indicative of a hose burst event is sensed.

10. The machine as defined in claim 1 wherein the second sensor is disposed on the tilt ram.

11. The machine as defined in claim 1, wherein the signal indicative of the lift command is communicated to the second sensor via the first sensor, when the signal indicative of the hose burst event is not sensed by the first sensor.

12. A method of operating a machine including the steps:

providing machine including:

a machine body;

a lifting arm assembly coupled to the machine body and carrying a pivotal mounting arrangement adapted to receive a working implement, the lifting arm assembly being moveable between a raised and a lowered configuration with respect to the machine body;

a compensation ram coupled between the machine body and the lifting arm assembly and configured to extend and retract with movement of the lifting arm assembly between the raised and lowered configurations;

a tilt ram configured to move the pivotal mounting assembly between a crowd and a dump configuration, the tilt ram having a first and a second chamber;

a first sensor for sensing a signal indicative of a hose burst event;

a second sensor for sensing a signal indicative of a lift command for raising the lifting arm; and a hose burst protection system coupled to the second chamber of the tilt ram such that fluid leaving the second chamber of the tilt ram passes into the hose burst protection system; and the method further including the steps of:

generating a first signal indicative of the absence of a hose burst event by providing a fluid pressure in the first chamber of the tilt ram;

sensing the first signal by the first sensor;

generating a second signal indicative of a lift command to raise the lifting arm assembly;

sensing the second signal by the second sensor; and allowing the passage of fluid from the second chamber of the tilt ram through the second sensor to a chamber of the compensation ram.

13. The method as defined in claim 12, comprising communicating the signal indicative of the lift command to the second sensor via the first sensor, when the first signal is sensed by the first sensor.

14. A machine including:

a machine body;

a lifting arm assembly coupled to the machine body and carrying a pivotal mounting arrangement adapted to receive a working implement, the lifting arm assembly being moveable between a raised and a lowered configuration with respect to the machine body;

a compensation ram coupled between the machine body and the lifting arm assembly and configured to extend and retract with movement of the lifting arm assembly between the raised and lowered configurations;

a tilt ram configured to move the pivotal mounting assembly between a crowd and a dump configuration, the tilt ram having a first and a second chamber;

a sensor for sensing: (i) a signal indicative of a hose burst event by sensing a signal indicative of a fluid pressure in the first chamber of the tilt ram, and (ii) a signal indicative of a neutral circuit pressure by sensing the signal indicative of the fluid pressure in the first chamber of the tilt ram; and a hose burst protection system distinct from the sensor and coupled to the second chamber of the tilt ram such that fluid leaving the second chamber of the tilt ram passes into the hose burst protection system, the hose burst protection system being configured to allow the passage of fluid from the second chamber of the tilt ram to a chamber of the compensation ram when a hose burst event is not sensed by the sensor and a neutral circuit pressure is sensed by the sensor.

15. The machine as defined in claim 14, wherein the hose burst protection system is configured to permit the flow of fluid from the second chamber of the tilt ram if the tilt ram is being controlled to move the pivotal mounting arrangement towards the dump configuration.

16. The machine as defined in claim 14, wherein the sensor senses a signal indicative of a hose burst event by sensing a signal indicative of a fluid pressure in the first chamber of the tilt ram below the neutral circuit pressure.

17. The machine as defined in claim 16, wherein the sensor is a pressure sensor which outputs an electric signal representative of the fluid pressure in the first chamber of the tilt ram.

18. The machine as defined in claim 16 wherein the sensor is a valve hydraulically coupled to the first chamber of tilt ram to sense the fluid pressure in the first chamber of the tilt ram.

19. The machine as defined in claim 14 including a valve operable to allow the passage of fluid from the second chamber of the tilt ram to the chamber of the compensation ramp upon the valve sensing the neutral circuit pressure.

20. The machine as defined in claim 14, wherein a signal indicative of a lift command is communicated to the hose burst protection system via the sensor, when the signal indicative of the hose burst event is not sensed by the sensor.

21. A method of operating a machine including the steps:

providing machine including:

a machine body;

a lifting arm assembly coupled to the machine body and carrying a pivotal mounting arrangement adapted to receive a working implement, the lifting arm assembly being moveable between a raised and a lowered configuration with respect to the machine body;

a compensation ram coupled between the machine body and the lifting arm assembly and configured to extend and retract with movement of the lifting arm assembly between the raised and lowered configurations;

a tilt ram configured to move the pivotal mounting assembly between a crowd and a dump configuration, the tilt ram having a first and a second chamber; and a sensor for: (i) sensing a signal indicative of a hose burst event by sensing a signal indicative of a fluid pressure in the first chamber of the tilt ram, and (ii) a signal indicative of a neutral circuit pressure by sensing the signal indicative of the fluid pressure in the first chamber of the tilt ram; and a hose burst protection system distinct from the sensor and coupled to the second chamber of the tilt ram such that fluid leaving the second chamber of the tilt ram passes into the hose burst protection system; and the method further including the steps of:

generating a signal indicative of the presence of a neutral circuit pressure;

sensing the signal by the sensor; and allowing the passage of fluid from the second chamber of the tilt ram to a chamber of the compensation ram.

22. The method of operating a machine as defined in claim 21 further including the steps of generating a signal indicative of a hose burst event, sensing the signal indicative of the hose burst event by the sensor, and preventing the passage of fluid from the second chamber of the tilt ram to the chamber of the compensation ram.

23. The method as defined in claim 21, comprising communicating a signal indicative of a lift command to the hose burst protection system via the sensor, when the signal indicative of the hose burst event is not sensed by the sensor.

* * * * *